US005758857A

United States Patent [19]

Gray

[11] Patent Number: 5,758,857

[45] Date of Patent: Jun. 2, 1998

[54] SOCCER POLE STAKE APPARATUS

[76] Inventor: Jason Andrew Gray, 3449 Lichau Rd., Penngrove, Calif. 94951

[21] Appl. No.: 701,523

[22] Filed: Aug. 26, 1996

[51] Int. Cl.[6] ..... A45F 3/44; F16M 13/00

[52] U.S. Cl. ..... 248/530; 248/156; 52/165; 52/103

[58] Field of Search ..... 248/530, 511, 248/519, 523, 524, 545, 156, 411, 532, 533, 508, 85, 87; 52/155, 165, 166, 292, 169.13, 103; 135/118

[56] References Cited

U.S. PATENT DOCUMENTS

| | | | |
|---|---|---|---|
| 2,059,921 | 11/1936 | Weiss | 248/530 |
| 2,976,346 | 3/1961 | Bellamy | 248/156 |
| 3,182,936 | 5/1965 | Murdock | 248/530 |
| 3,326,225 | 6/1967 | Banks | 135/118 X |
| 3,519,234 | 7/1970 | Matson | 248/156 |
| 4,455,795 | 6/1984 | Cole | 52/165 X |
| 4,520,985 | 6/1985 | Blumenthal | 248/530 |
| 5,076,032 | 12/1991 | Lehman | 248/530 X |
| 5,230,187 | 7/1993 | Reimann | 248/545 X |
| 5,305,976 | 4/1994 | Blanchard | 248/530 X |

*Primary Examiner*—Derek J. Berger
*Assistant Examiner*—Stephen S. Wentsler
*Attorney, Agent, or Firm*—Larry D. Johnson

[57] ABSTRACT

A stake assembly for the support of soccer poles and other tubular structures includes a pair of generally parallel vertical members affixed together and spaced a desired distance apart by an upper lateral member interposed between the vertical members proximate their upper portion, and a lower lateral member interposed between the vertical members proximate their medial portion, such that the distance between the outside surfaces of the vertical members is generally equal to, and preferably slightly greater than, the inside diameter of the pole to be supported. Furthermore, the upper lateral member has a lateral extent generally equal to the inside diameter of the pole to be supported, while the lower lateral member has a lateral extent generally equal to the outside diameter of the pole to be supported. The vertical members terminate in a basal portion each preferably bearing an angled tip.

2 Claims, 2 Drawing Sheets

SOCCER POLE STAKE APPARATUS

BACKGROUND OF THE INVENTION

1. Field of the Invention

This invention relates generally to sporting goods and associated hardware, and more specifically to an improved stake apparatus that can be used to support soccer poles, corner markers, and the like.

2. Description of the Prior Art

Some soccer coaches use poles in their training sessions. These poles are simple in their design but are powerful training and teaching tools. They are of simple construction: a pole and a stake which holds the pole upright into the ground. These poles are so versatile they are the only equipment used in some training sessions.

Unfortunately, some known prior art poles are difficult to put into the ground. Others have exposed metal crossbars sticking out of the ground. Still others are difficult to get out of the ground, and some stakes routinely slip out of the pole and stay stuck in the ground where the pole is removed. This can be especially frustrating because the user has to get down and dig the stake out of the ground with their hands.

The other known pole structures on the market are designed for corner flags. Again, most are not designed with safety in mind and could be dangerous if someone ran into the pole. In addition, most do not have designs which are easy to put into or take out of the ground. Most require both the feet and hands to put into the ground, and are especially difficult to remove from the ground. Usually, it is necessary to get down and dig while pulling the stake with your hands, because the pole itself is too flexible and flimsy to generate enough leverage to pull the stake out of the ground. Other times the stake simply slides out of the pole when removal from the ground is attempted. Not only is this frustrating, it delays training time and takes away from other things that need to be done.

OBJECTS AND ADVANTAGES

Accordingly, it is an object of this invention to provide a soccer pole stake that is easy to put into and pull out of the ground.

It is a further object of this invention to provide a soccer pole stake that is safe to use (i.e., no exposed metal to fall on).

It is a further object of this invention to provide a soccer pole stake that will not slip out of the pole when extracted from the ground.

SUMMARY OF THE INVENTION

The soccer pole stake apparatus of this invention provides a stake assembly for the support of soccer poles and other tubular structures. The inventive apparatus includes a pair of generally parallel vertical members affixed together and spaced a desired distance apart by an upper lateral member interposed between the vertical members proximate their upper portion, and a lower lateral member interposed between the vertical members proximate their medial portion, such that the distance between the outside surfaces of the vertical members is generally equal to, and preferably slightly greater than, the inside diameter of the pole to be supported. Furthermore, the upper lateral member has a lateral extent generally equal to the inside diameter of the pole to be supported, while the lower lateral member has a lateral extent generally equal to (or greater than) the outside diameter of the pole to be supported. The vertical members terminate in a basal portion each preferably bearing an angled tip.

This arrangement enables the inventive assembly to be inserted into a pole or tube up to the point of the lower lateral member, such that the base of the pole rests on the upper surfaces of the lower lateral member (whose lateral extent is greater than the inside diameter of the pole, and thus prevents further insertion). The vertical member outside surfaces contact the inside surface of the pole along the entire length of their insertion, and the ends of the upper lateral member contact the inside surface of the pole at two points defining a line generally perpendicular to these lines of contact by the vertical members. The basal portion of the vertical members thus extend below the pole, and terminate in the angled tips.

Once the stake assembly has been inserted into the pole, the pole can itself be inserted into the ground, preferably to a depth equal to the exposed basal portion of the vertical members, such that the lower lateral member serves as a stop to further insertion.

The inventive stake apparatus thus uses four different elements of the construction to apply pressure to hold itself into its adjoining pole, which prevents it from slipping out of the pole when extracted from the ground. It has no exposed metal when it is in the ground, and poses no threat to anyone even if knocked over forcibly or slid into. It has two vertical elements in the ground which provide stability in every direction. These vertical elements have angled tips which facilitate easy penetration into even the hardest natural ground surface. These vertical elements thus become extensions of the pole, and allow for perpendicular penetration into the ground the first time. The inventive assembly can be made to fit with any diameter and height pole. Finally, the stake assembly's orientation in the pole allows for easy extraction of the pole from the ground.

The inventive stake assembly can be used for a multitude of tasks, for instance: corner flags, physical fitness training poles, ground markers, boundary markers, hiking trail signal/markers, golf course green markers, flags, banners, etc. The invention can be used for any product or activity aid which needs to be fixed to the ground via a pole.

Advantages of the inventive apparatus include:

a. The arrangement of the vertical members and the upper and lower lateral members compressed within the pole or tube makes the total assembly rigid.

b. The contact of the two vertical members with the inside of the pole or tube enhances rigidity.

c. The contact of the lower lateral member against the bottom of the pole or tube in a vertical direction prevents right-angle side motion. Also, the lower lateral member preferably does not extend beyond the outside diameter of the pole or tube.

d. The upper lateral member enhances the rigidity along the whole length of the assembly. This yields a rigid total assembly for installation into the ground. Furthermore, the pole stake assembly will not pull out of the pole or tube when it is removed from the ground.

e. The angle of the bottom tips of the parallel vertical members facilitates insertion into any ground surface. They are preferably sloped, sharp points able to penetrate irregular materials that may be present on or under the surface of the ground.

The soccer pole stake apparatus of this invention thus provides an improvement in athletic equipment. Using simple concepts and simple materials, the inventive device is easy to use, safe to use and has a diverse range of implementations in many different fields of interest.

DETAILED DESCRIPTION OF A PREFERRED EMBODIMENT

Figure 1:
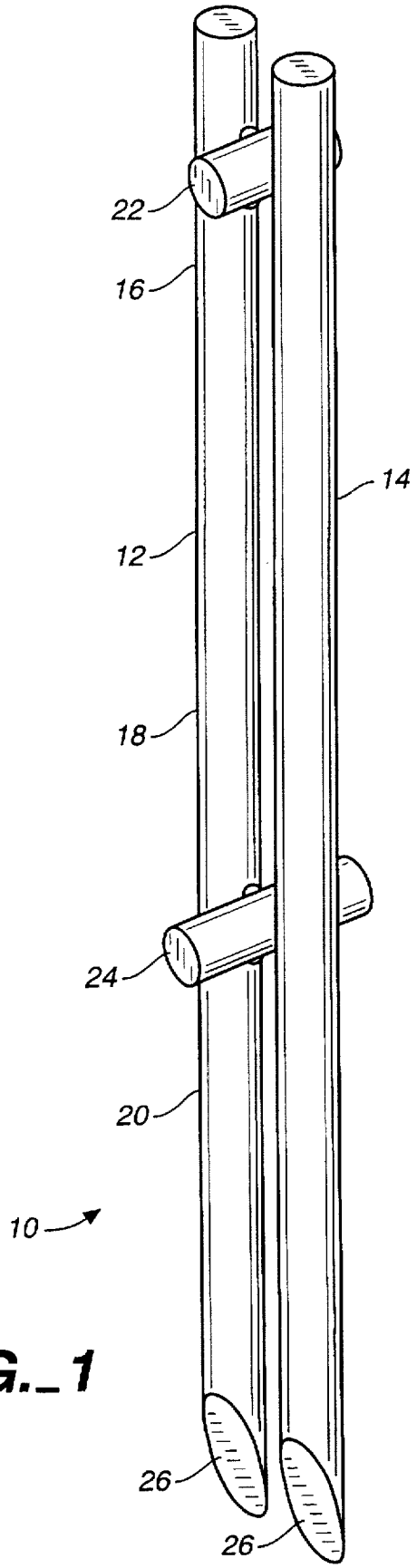
FIG. 1 is a perspective view of a soccer pole stake apparatus of this invention, illustrating its component parts including first and second vertical members each having an upper portion, medial portion, and basal portion, connected by an upper lateral member proximate the upper portions, and a lower lateral member proximate the medial portions, the basal portions terminating in angled tips.

FIG. 1 is a perspective view of a soccer pole stake apparatus 10 of this invention, illustrating its component parts including first and second vertical members 12, 14 each having an upper portion 16, medial portion 18, and basal portion 20, connected by an upper lateral member 22 proximate the upper portions 16, and a lower lateral member 24 proximate the medial portions 18, the basal portions terminating in angled tips 26.

Figure 2:
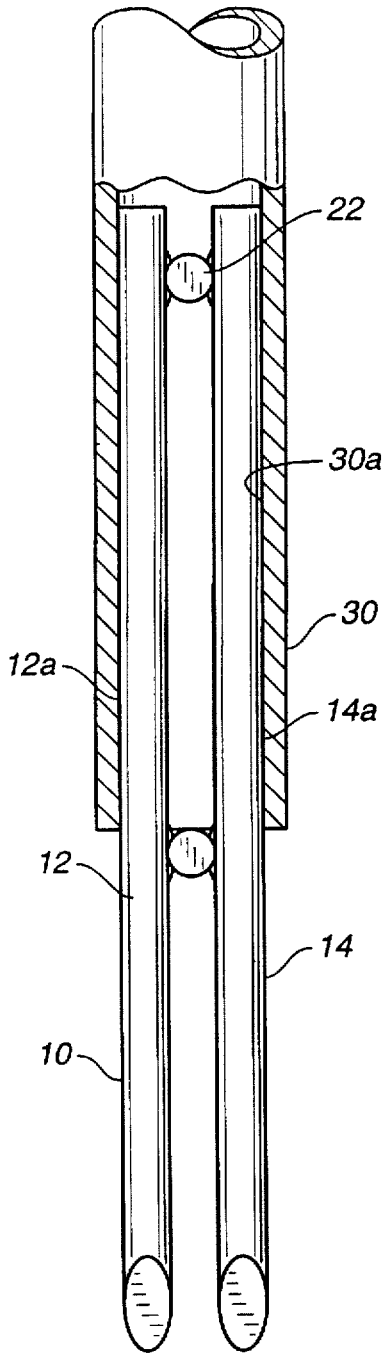
FIG. 2 is a partially cutaway front elevation view of the soccer pole stake apparatus of this invention as inserted into a pole, illustrating the lines of contact between the vertical member outside surfaces and the inside surface of the pole.

FIG. 2 is a partially cutaway front elevation view of the soccer pole stake apparatus 10 of this invention as inserted into a pole 30, illustrating the lines of contact between the vertical member 12, 14 outside surfaces 12*a*, 14*a* and the inside surface 30*a* of the pole 30.

Figure 3:
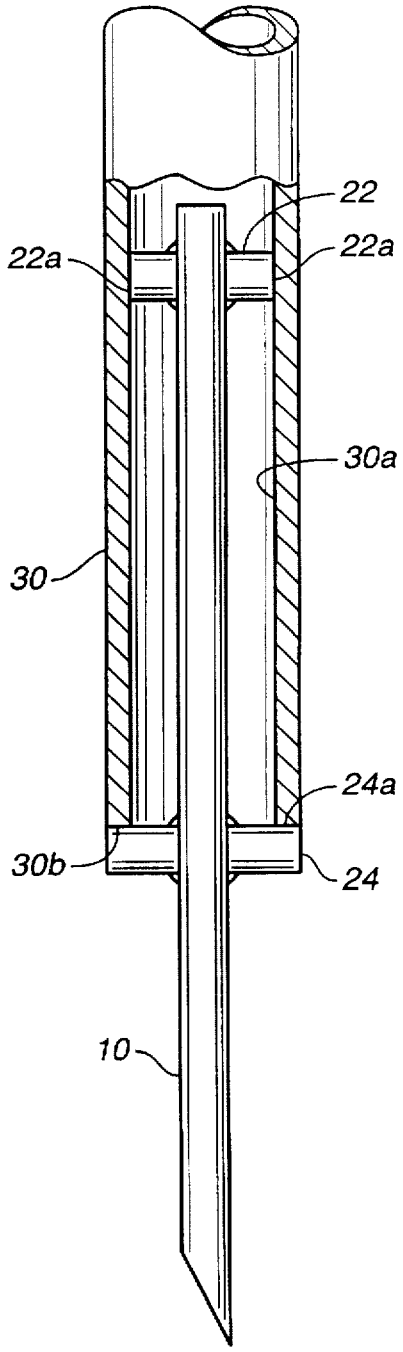
FIG. 3 is a partially cutaway side elevation view of the soccer pole stake apparatus of this invention as inserted into a pole, illustrating the points of contact of the ends of the upper lateral member with the inside surface of the pole, and the upper surfaces of the lower lateral member with the bottom of the pole.

FIG. 3 is a partially cutaway side elevation view of the soccer pole stake apparatus 10 of this invention as inserted into a pole 30, illustrating the points of contact of the ends 22*a* of the upper lateral member 22 with the inside surface 30*a* of the pole 30, and the upper surfaces 24*a* of the lower lateral member with the bottom edge 30*b* of the pole 30.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A pole and support stake assembly comprising:

a pole having an outside diameter, a bottom edge, and an inside surface having an inside diameter; and a support stake having a pair of generally parallel vertical members each having an upper portion, medial portion, and basal portion; an upper lateral member interposed between and connecting said first and second vertical members proximate said upper portions, said upper lateral member having a pair of ends and a lateral extent generally equal to said inside diameter of said pole; and a lower lateral member interposed between and connecting said first and second vertical members proximate said medial portions, said lower lateral member having a lateral extent generally equal to said outside diameter of said pole, wherein said support stake is adapted to be inserted into said pole up to said lower lateral member, such that said bottom edge of said pole rests on said lower lateral member, and said vertical members contact said pole inside surface generally along the entire length of their insertion, and said ends of said upper lateral member contact said inside surface of said pole at two points defining a line generally perpendicular to said vertical members.

2. The pole and support stake assembly of claim 1 wherein said vertical member basal portions terminate in angled tips.

* * * * *